US008037706B2

(12) United States Patent
Görz et al.

(10) Patent No.: US 8,037,706 B2
(45) Date of Patent: Oct. 18, 2011

(54) REFRIGERATION DEVICE WITH A MODULAR CONFIGURATION FOR THE CONTROL SYSTEM AND EVAPORATOR

(75) Inventors: Alexander Görz, Aalen (DE); Renate Pradel, Giengen (DE); Ralf Spiller, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 422 days.

(21) Appl. No.: 12/085,646

(22) PCT Filed: Oct. 18, 2006

(86) PCT No.: PCT/EP2006/067540
§ 371 (c)(1),
(2), (4) Date: May 27, 2008

(87) PCT Pub. No.: WO2007/062910
PCT Pub. Date: Jun. 7, 2007

(65) Prior Publication Data

US 2009/0133425 A1 May 28, 2009

(30) Foreign Application Priority Data

Nov. 30, 2005 (DE) ..... 10 2005 057 142

(51) Int. Cl.
*F25D 21/06* (2006.01)

(52) U.S. Cl. ..... 62/275; 62/443

(58) Field of Classification Search ..... 62/275, 62/264, 285, 440, 515, 419, 443, 259.1; 312/317, 312/223.1, 223.2
See application file for complete search history.

(56) References Cited

U.S. PATENT DOCUMENTS

| | | | | |
|---|---|---|---|---|
| 2,319,878 | A | 5/1943 | Philipp | |
| 2,943,455 | A | 7/1960 | Reverman, Jr. | |
| 2,962,872 | A | 12/1960 | Crotser et al. | |
| 3,572,049 | A | 3/1971 | Moorman | |
| 4,176,525 | A * | 12/1979 | Tucker et al. | 62/238.1 |
| 4,893,478 | A | 1/1990 | Kruck et al. | |
| 5,187,950 | A | 2/1993 | Weldon | |

(Continued)

FOREIGN PATENT DOCUMENTS

CN 2392140 Y 8/2000

(Continued)

OTHER PUBLICATIONS

International Search Report PCT/EP2006/067540.

*Primary Examiner* — Mohammad Ali
(74) *Attorney, Agent, or Firm* — James E. Howard; Andre Pallapies

(57) ABSTRACT

A refrigeration device, in particular a no-frost device, refrigerator and/or freezer, comprising a thermally insulating housing containing at least one product storage compartment that can be supplied with cold air by a fan and an evaporator chamber that holds an evaporator. According to the invention, the evaporator chamber is thermally separated from the storage compartment by a partition. The device also comprises an electronic control system for controlling the refrigeration device and at least one light source for illuminating the storage compartment. The evaporator, the partition and the electronic control system and/or the evaporator, the partition and the light source are provided in the form of modules. The refrigeration device is characterized in that it is particularly reliable, works efficiently, can be cost-effectively produced and is easy to service.

18 Claims, 12 Drawing Sheets

U.S. PATENT DOCUMENTS

| | | | | |
|---|---|---|---|---|
| 6,351,962 | B1 * | 3/2002 | Mizutani et al. | 62/244 |
| 2001/0020365 | A1 * | 9/2001 | Kubo et al. | 62/1 |
| 2004/0144128 | A1 | 7/2004 | Junge et al. | |
| 2004/0200229 | A1 * | 10/2004 | Kubo et al. | 62/222 |

FOREIGN PATENT DOCUMENTS

| | | | |
|---|---|---|---|
| DE | 39 25 676 | | 2/1991 |
| DE | 93 05 187 | U | 6/1993 |
| DE | 44 20 149 | | 12/1995 |
| DE | 198 55 224 | | 5/2000 |
| EP | 1 006 325 | | 6/2000 |
| FR | 2 423 737 | | 11/1979 |
| FR | 2 579 304 | | 9/1986 |
| FR | 2 674 617 | | 10/1992 |
| JP | 2004317031 | A | 11/2004 |
| WO | WO 2006/108649 | | 10/2006 |

* cited by examiner

Fig. 7
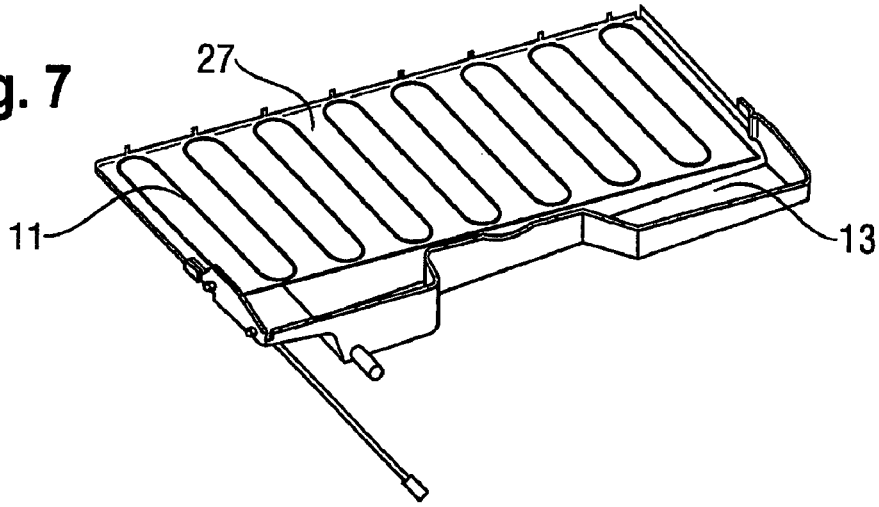
Fig. 8
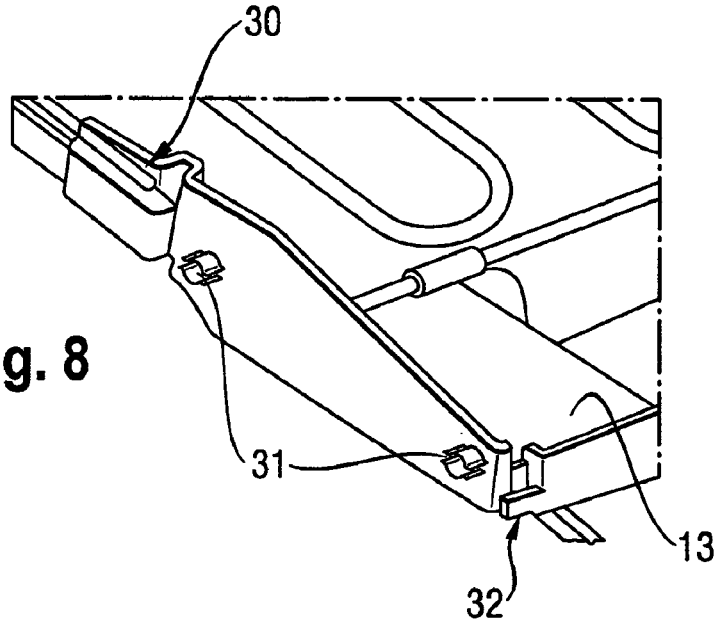
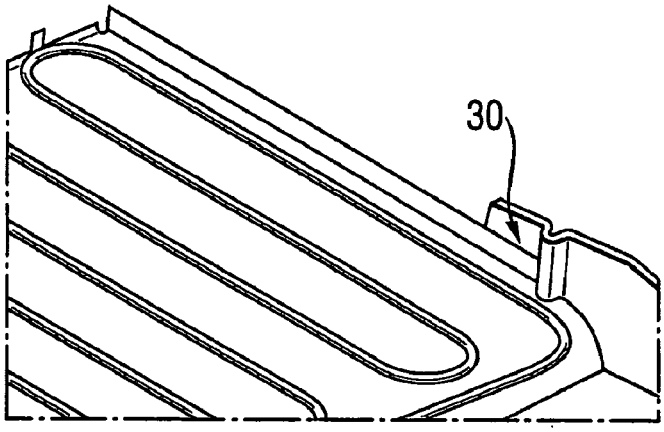
Fig. 9

REFRIGERATION DEVICE WITH A MODULAR CONFIGURATION FOR THE CONTROL SYSTEM AND EVAPORATOR

BACKGROUND OF THE INVENTION

The invention relates to a refrigeration device, especially a no-frost device, refrigerator and/or freezer, comprising a thermally-insulating housing within which at least one product storage compartment that can be supplied with cold air by a fan and an evaporator chamber that holds the evaporator are provided, with the evaporator being thermally separated from the storage compartment by a partition, an electronic control system for control of the refrigeration device and at least one light source for illuminating the storage compartment.

There are known refrigeration devices, especially refrigerators, freezers and fridge-freezer combinations with circulating air cooling that feature a metallic inner container. In these devices a cold air generator can be arranged in the upper area of the cooling compartment. It has been established for a number of different reasons that the optimum position for the cold air generator, such as an evaporator for example, which is embodied in no-frost technology as a fin evaporator, lies in an upper area of the respective cooling compartment. The insulation thicknesses of the devices can vary at the device rear walls.

DE 198 55 224 discloses a refrigeration device with an evaporator arranged in the upper area of the cooling compartment.

To reduce material costs and investment when manufacturing the refrigeration device, it is desirable, in order to achieve the highest possible efficiency of the refrigeration device, to design the process of installing the components and the modules to be fast, simple and as error-free as possible and to achieve a high level of operational safety and operational reliability even under extreme conditions.

BRIEF SUMMARY OF THE INVENTION

The object of the present invention is to provide a refrigeration device which operates reliably and efficiently, can be manufactured at low cost and is easy to maintain.

In accordance with the invention this object is achieved by the refrigeration device as specified in the independent claim. Further advantageous embodiments and developments, which can be applied individually in each case or can be combined in any given way, are the subject matter of the dependent claims.

The inventive refrigeration device, especially a no-frost device, refrigerator and/or freezer, comprises a thermally-insulating housing, within which at least one product storage compartment that can be supplied with cold air by a fan and an evaporator chamber that holds the evaporator are provided, with the evaporator chamber being thermally separated from the storage compartment by a partition. The refrigeration device further comprises an electronic control system for control of the refrigeration device and at least one light source for illuminating the storage compartment, with the evaporator and the partition and the electronic control system and/or the evaporator and the partition and the light source being provided as modules.

In the refrigeration device the evaporator together with the electronic control system or the light source are accommodated as a modular evaporator package together with an integrated illumination in the thermally-insulating housing. Housings insulated by insulating foam as well. Vacuum-insulated housings can be used as housings.

The storage compartment is supplied with cold air by the cold air circulated by the fan which is cooled by the evaporator. The evaporator has a fluid-conducting connection to a compressor or condenser arranged outside the thermally-insulating housing.

The electronic control system in particular features a display. The electronic control system is used to control the technical control variables of the refrigeration device, especially the temperatures in the refrigeration device.

The modular embodiment of the evaporator, the partition and the electronic control system, or of the evaporator, the partition and the light source, makes the refrigeration device especially simple to assemble and also especially simple to maintain. The module is especially able to be plugged in, pre-installed, removed or exchanged. The advantage of this modular concept is that different technical components which do not belong to the functional scope of an evaporator as such, such as motor, gears for motor-driven storage compartments, illumination or control, can be arranged in a compact and easy-to-maintain manner. There is a shared technology area inside the housing which can be easily accessed by service engineers and if necessary can also be taken out or replaced as a complete unit. This is especially advantageous if the refrigeration device is provided as a built-in device and cannot easily be removed from a fitted unit.

Advantageously the module has a condensation drainage channel. The condensation drainage channel takes away condensation which forms in the evaporator. The modular structure means that only a single condensation drainage channel is necessary for different device types, reducing the component diversity. The condensation drainage channel can perform various retaining and latching functions for a heat transfer plate as well for a heating device.

Advantageously the module also features a heating device. The heating device can be embodied with a heat transfer plate. The heating device is especially arranged underneath the condensation drainage channel. The heating device and the condensation drainage channel enable condensation to be removed reliably, especially at regular intervals, from the evaporator, with reliable operation of the refrigeration device also being guaranteed for high humidity levels and heavy ice formation.

The heat transfer plate enables the heat generated by the heating device on the evaporator to be distributed evenly over the evaporator, with a rapid defrosting of the ice which has formed on the evaporator being made possible.

The heating device is in particular a planar design and can be provided as a heating foil or a heating element. The water melted with the aid of the heating device is caught by the condensation drainage channel and directed out of the interior to the outside, especially into an external evaporation tray.

Advantageously the housing has opposite side walls and the module comprises further plastic side support parts with which the module is able to be attached to the side walls. The plastic side support parts, especially together with the evaporator, form a support frame, on which other refrigeration device components can be attached to the module.

With the aid of the plastic side support parts the evaporator can also especially be thermally insulated from a metallic inner lining of the refrigeration device. An undesired formation of ice on the metallic internal panel in the storage compartment can be avoided in this way. An entry of heat into the storage compartment can also be reduced by this if the evaporator is in its defrosting phase and is heated up. The efficiency of the refrigeration device is improved by this measure.

The plastic side support parts also perform a protective function for the evaporator which is embodied as a rule as a fin evaporator and is thus very sensitive, should the evaporator have to be transported.

In an advantageous embodiment of the invention each of the plastic side support parts is divided into two. To this end the plastic side support parts have a front and a rear side part, which considerably simplifies installation of the module. The two-part design of the plastic side support parts can also to make allowances for depth if the same module is to be used for different refrigeration device of a model range. It is thus possible to use the same components for different device models of a range, without any particular adaptation of the individual components being necessary. This also reduces the component diversity of a model range.

Advantageously the module has a cross support for accommodating the light source and/or the electronic control system. The cross support can especially connect the two plastic side support parts to each other on the left and the right. The cross support can be attached to the plastic side support parts and is especially made from a metal. The cross support improves the mechanical stability of the module, especially of the part of the module to which the light source or the electronic control system is attached.

Advantageously the partition comprises an evaporator-side first insulation layer and a storage compartment-side cover plate. The first insulation layer is used for thermal decoupling of the evaporator chamber from the storage compartment, which is especially advantageous for the defrosting cycles of the evaporator, in order to prevent a disproportionate entry of heat into the storage compartment if the evaporator is in a defrosting phase. The storage compartment-side cover plate is advantageously made of metal, in order to support an even temperature distribution in the interior of the storage compartment. The insulation layer especially features an insulating foam. The insulation layer can have a thickness ranging from 5 mm to 30 mm, preferably from 10 mm to 15 mm.

In an especially advantageous embodiment of the invention the module is able to be connected to the refrigeration device by electrical connections. To this end plug contacts are provided on an inner lining of the thermally-insulating housing. Because of the good accessibility, the functional integrity of the plug contacts which as a rule can frequently be the source of malfunctions of the refrigeration device, can easily be checked during the maintenance of the refrigeration device. The plug contacts can be replaced if necessary. Advantageously the connectors are arranged below the condensation drainage channel, so that the connectors are protected from condensation.

The condensation drainage channel has a slight incline so that the water can run away. The angle of condensation drainage channel to the horizontal level ranges from 4° to 20°, preferably ranges from 6° to 10°.

The module is advantageously able to be pre-assembled and can be tested outside the refrigeration device before being built into the refrigeration device. The functional integrity of the components of the modular structure, especially those of the evaporator, the illumination, the electronic control system and the other functionalities such as the heating device, a fan etc., can this be checked before the module is built into the refrigeration device, specified and revised where necessary. This reduces the manufacturing costs of the refrigeration device in a significant way.

The module advantageously features the fan. Cold air can be circulated with the aid of the fan from the evaporator chamber into the storage compartment and back again.

Advantageously the housing features a roof panel and the module includes a second insulation layer for thermal insulation of the module from the roof panel. The coldest area in the housing, namely the evaporator, is especially well thermally insulated by the second insulation layer, which increases the efficiency of the refrigeration device. In addition the second insulation layer also performs a protection function for the evaporator during transport.

Advantageously the housing has a metallic inner lining.

In a special embodiment of the invention the light source comprises white light-emitting diodes.

BRIEF DESCRIPTION OF THE DRAWINGS

Further advantageous details and specific embodiments, which can be employed individually or can be combined in a suitable manner in any way with each other, are explained in greater detail with reference to the following drawing, which is not intended to restrict the invention, but is merely designed to illustrate it through examples.

The figures show the following schematic diagrams.

DETAILED DESCRIPTION OF THE PRESENT INVENTION

Figure 1:
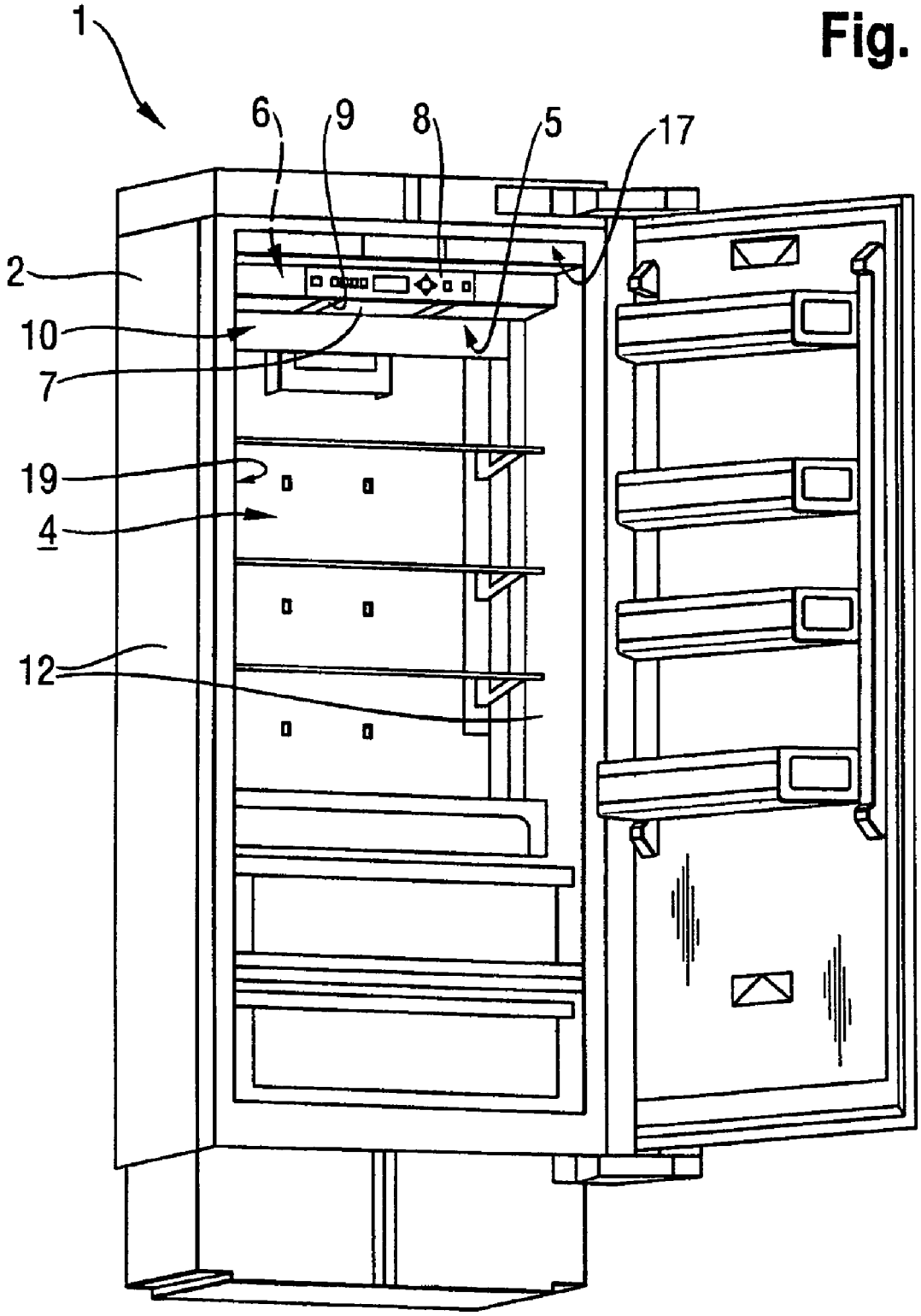
FIG. 1 an inventive refrigeration device in a perspective view.

FIG. 1 shows an inventive refrigeration device 1 with a thermally-insulating housing 2, within which at least one storage compartment 4 for storing products (not shown), that can be supplied with cold air by a fan 3, and an evaporator chamber 6 that holds an evaporator 5 is provided. The evaporator chamber 6 is thermally separated from the storage compartment 4 by a partition 7. The housing 2 has side walls 12. The evaporator 5 is provided together with the partition 7 and an electronic control system 8 and/or a light source 9 as a module 10. The housing 2 has an inner lining 19 which is made of metal. A roof panel 17 is provided the interior of the housing 2.

Figure 2:
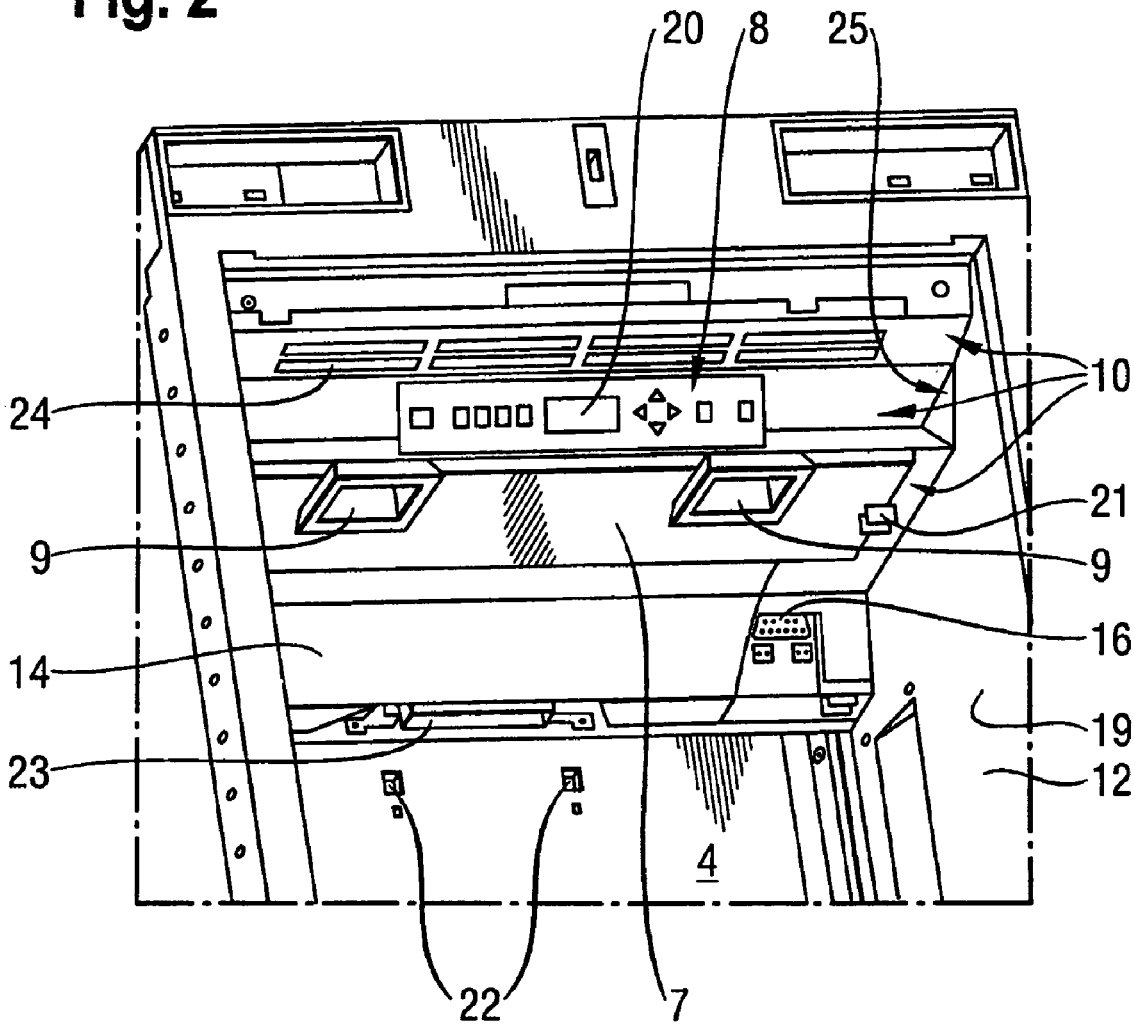
FIG. 2 a part view of the refrigeration device as depicted in FIG. 1 in a sectional view, FIG. 3 the part view depicted in FIG. 2 after removal of the cover plate, FIG. 4 a rear view of a module provided in the inventive refrigeration device without a second insulation layer and cover plate, FIG. 5 the module depicted in FIG. 4 with a fin evaporator, FIG. 6 the module depicted in FIG. 4 without evaporator and cover plate, FIG. 7-9 sections which show a heat transfer plate, FIG. 10 a part view of the inventive refrigeration device, FIG. 11 a cross support with electronic control system and illumination in a perspective view, FIG. 12 a perspective view of the module from below, FIG. 13 a perspective view of the module from above, FIG. 14 a perspective view of a section of the inventive kitchen device, and FIG. 15 a view in the interior of the inventive kitchen device without the module.

FIG. 2 shows a perspective sectional view of a section of the inventive refrigeration device 1 as depicted in FIG. 1. The electronic control system 8 has a display 20. The module 10 has first 23 and second 24 air channels through which cold air can be sucked in or blown out. The cold air is cooled in the evaporator 5 arranged in the module 10. In addition to the evaporator 5 and the electronic control system 8, the module also features the light source 9 which is a halogen spotlight in this case. The module 14 features a partition 7 with an insulation layer 14, through which the evaporator chamber 6 is thermally separated from the storage compartment 4. The insulation layer 14 is concealed or covered in relation to the storage chamber 4 by a cover plate 15. After the cover plate 15 is removed connectors 16 for electrical and/or fluid connection of the module 10 to the refrigeration device 1 can be seen. First connection elements 21 for connection of the cover plate 15 to the module 10 are provided. The module 10 is attached with the aid of plastic side support parts 25, 26 to the side walls 12 or to the inner lining 19. The plastic side support parts 25, 26 contribute to decoupling the evaporator 5 from the inner lining 19, in order to reduce heat entering the storage chamber 4 from the evaporator chamber 6 during a defrosting phase of the evaporator 5. Cold air guide channels (not shown) can be attached to the inner lining 19 with the aid of second connecting elements.

Figure 3:
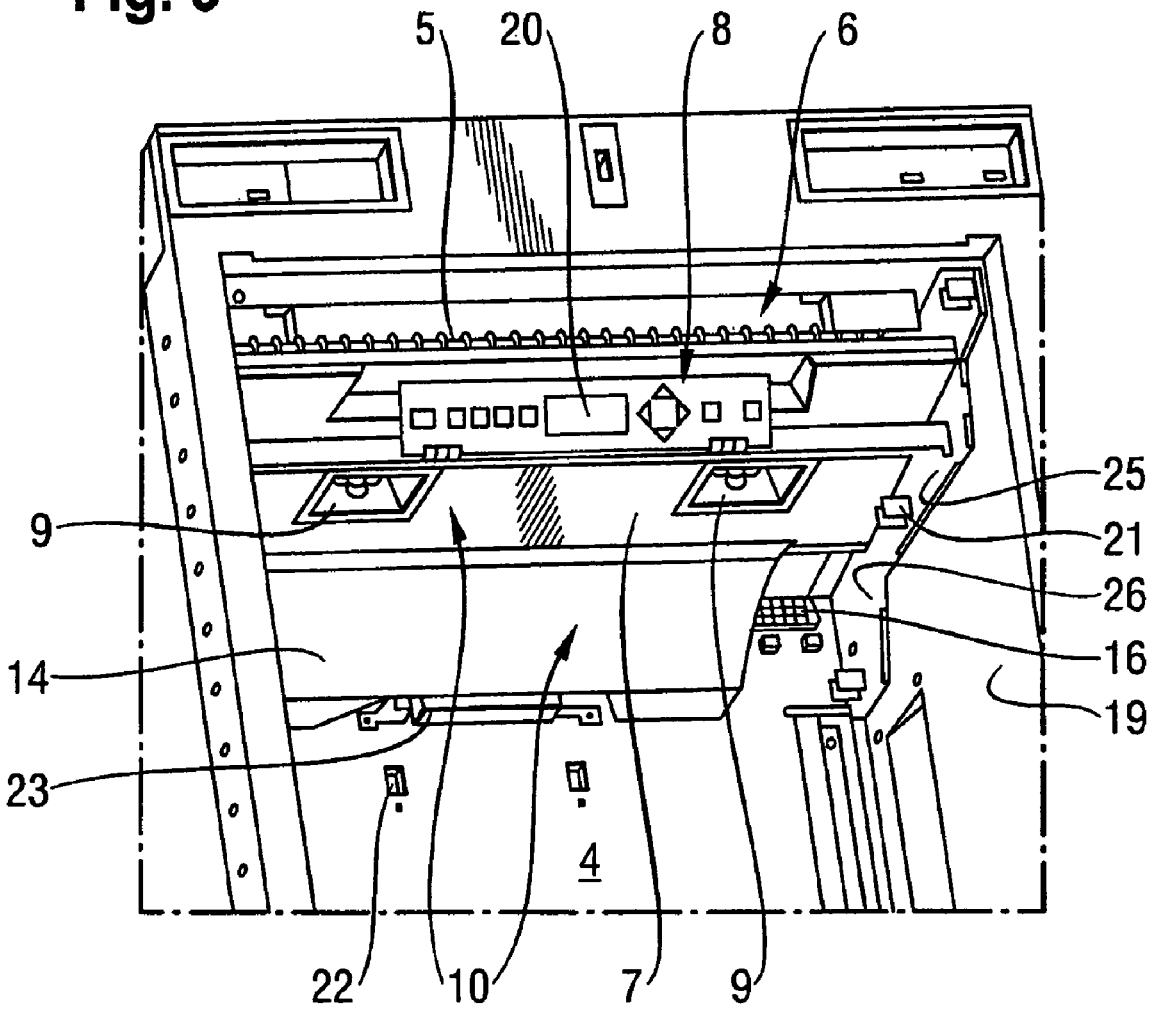

FIG. 3 shows a part section according to FIG. 2 after removal of the cover plate 15, with as well as the electronic control system 8, with the display 20, the evaporator chamber 6 with the evaporator 5, the connectors 16 required for the functional connection of the module 10, a rear plastic side support part 26 and a front plastic side support part 25 now being visible. The cover plate 15 is attached to the module 10 using the first connection element. A cooling air duct (not shown) or a fan 3 can be attached to a rear wall of the storage compartment 4 the aid of a second connection element 22.

Figure 4:
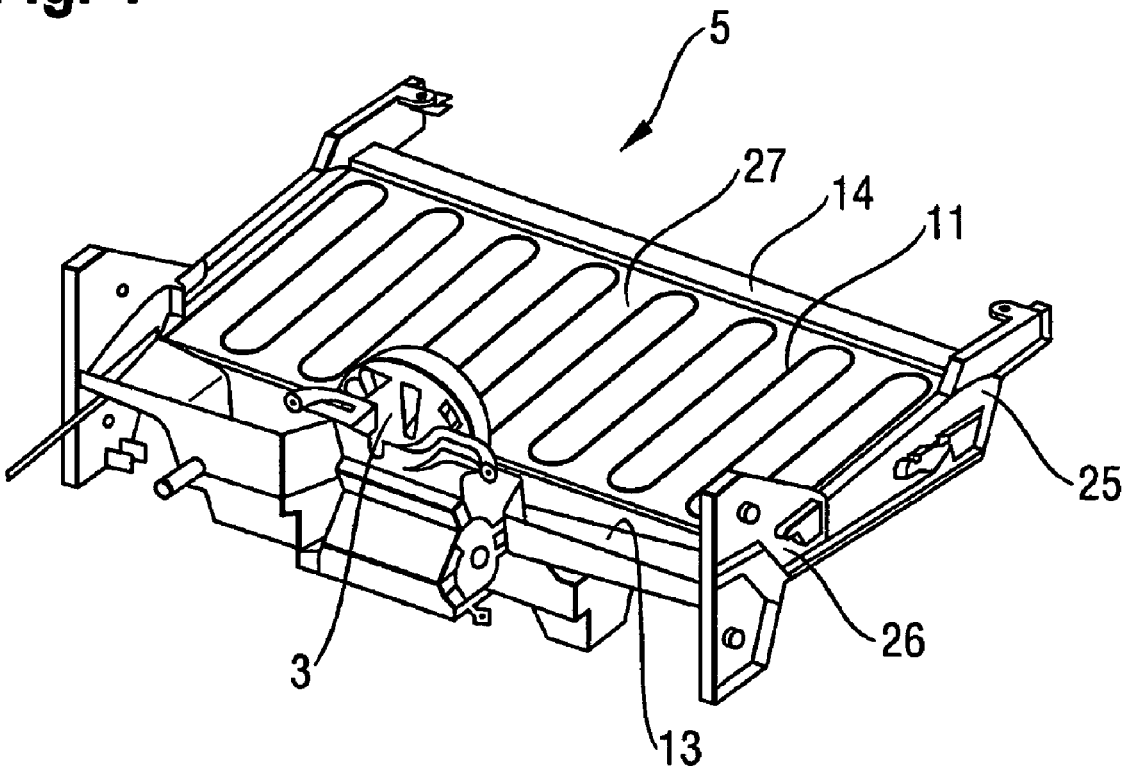

FIG. 4 shows a rear view of a module 10 provided for the inventive refrigeration device 1, with a second insulation layer 18, which is used for further thermal insulation of the evaporator 5 from the roof panel 17, as well as the cover panel 15 not being shown in the figure to improve clarity. The evaporator 5 features a heating device 11 with which ice can be removed from the evaporator 5 at regular intervals by defrosting. The condensation formed is caught by a condensation drainage channel 13. The condensation drainage channel 13 is at an angle of 6° to the horizontal, so that condensation can flow away and can be collected in an evaporator tray (not shown) located outside the storage compartment 4. The condensation drainage channel 13 and the heating device 11 are attached to the plastic side support parts 25, 26. A fan 3 is used for air circulation, so that warmer air is taken from the storage compartment past the evaporator 5 and cooled off there and subsequently introduced as cool air into the storage compartment 4.

Figure 5:
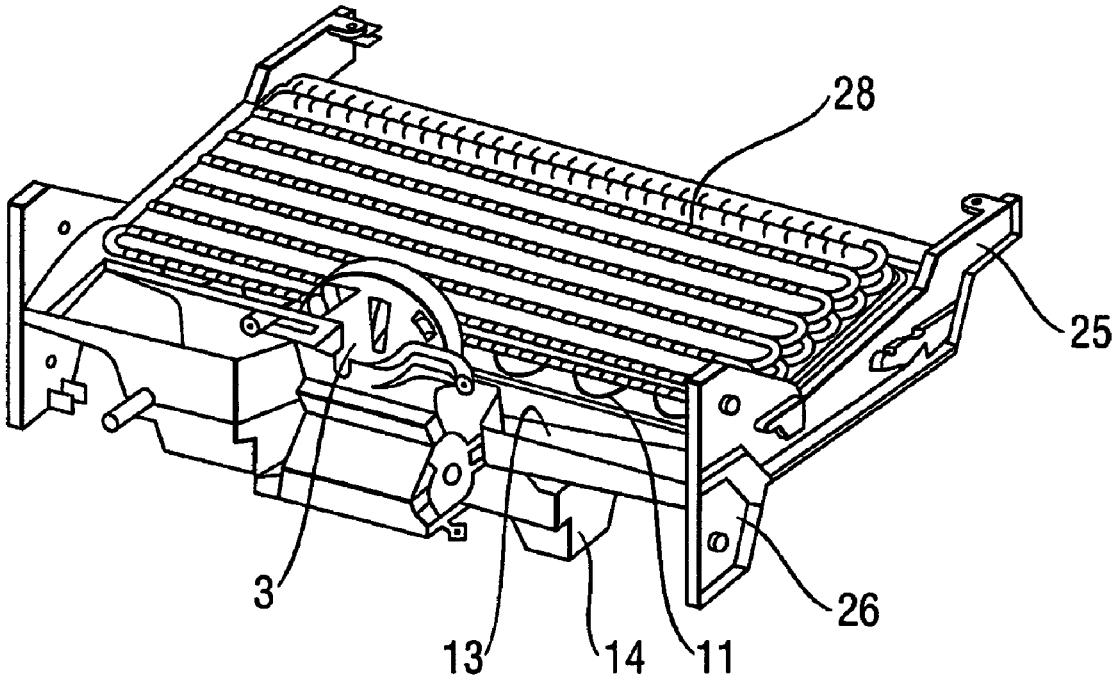

FIG. 5 shows the module 10 depicted in FIG. 4 with an evaporator 5 designed as a fin evaporator. The evaporator 5 has evaporator fins 28 which are supported mechanically by the side support parts 25, 26. Below the evaporator 5 towards the storage compartment 4 the insulation layer 14 is provided for thermal separation of the storage chamber 4 from the evaporator chamber 6.

Figure 6:
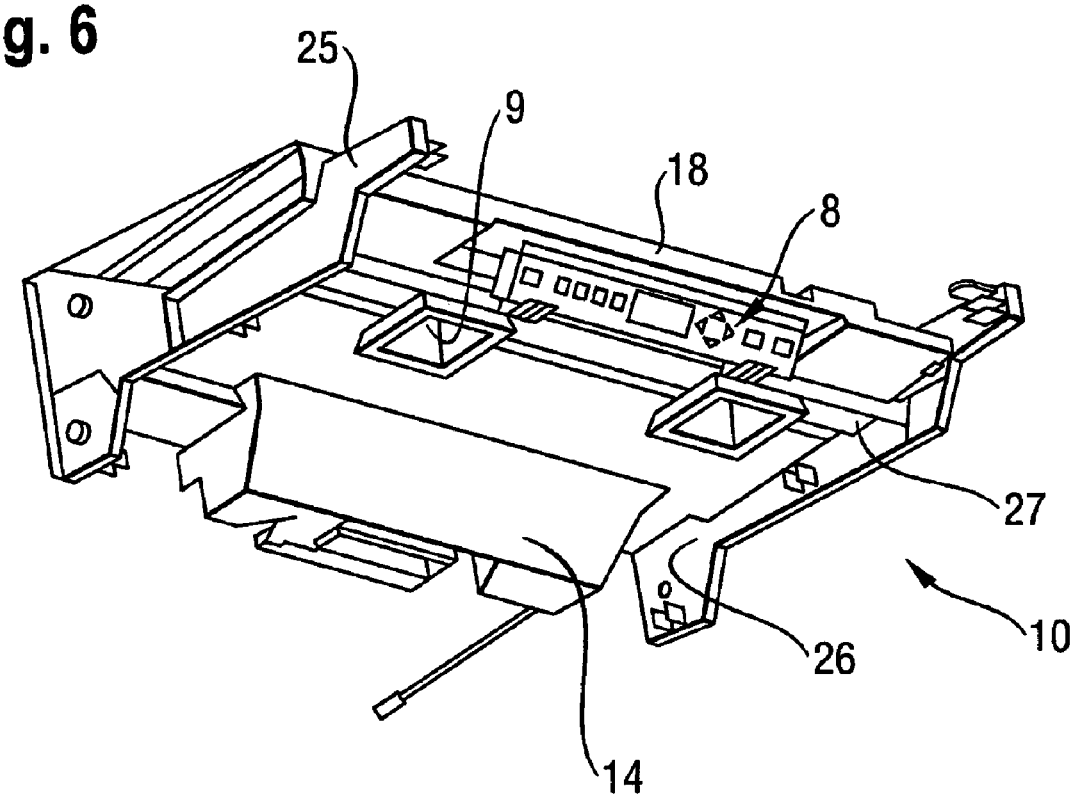

FIG. 6 shows the module depicted in FIG. 4 without the evaporator 5 and the cover plate 15, with the insulation layer 14 visible, which is attached to the rear plastic side support part 26. A heat transfer plate 27 for planar distribution of the heat generated by the heating device 11 is provided below the condensation drainage channel 13 and thus below the evaporator 5. Above the evaporator 5 towards the roof panel 17 of the housing 2 the second insulation layer 18 can be seen.

FIGS. 7-9 show different part views of the module 10, with the heating device 11 with the heat transfer plate 27 being visible in FIG. 7. The heating device 11 and the heat transfer plate 27 are located above the condensation drainage channel 13. FIG. 8 or FIG. 9 show a part view of the condensation drainage channel 13, with a undercut structure 30, third connection elements 31 as well as a through slot and attachment hooks 32 to be seen with which the condensation drainage channel 13, the heating device 11 and the heat transfer plate 27 are attached to the plastic side support parts 25, 26.

Figure 10:
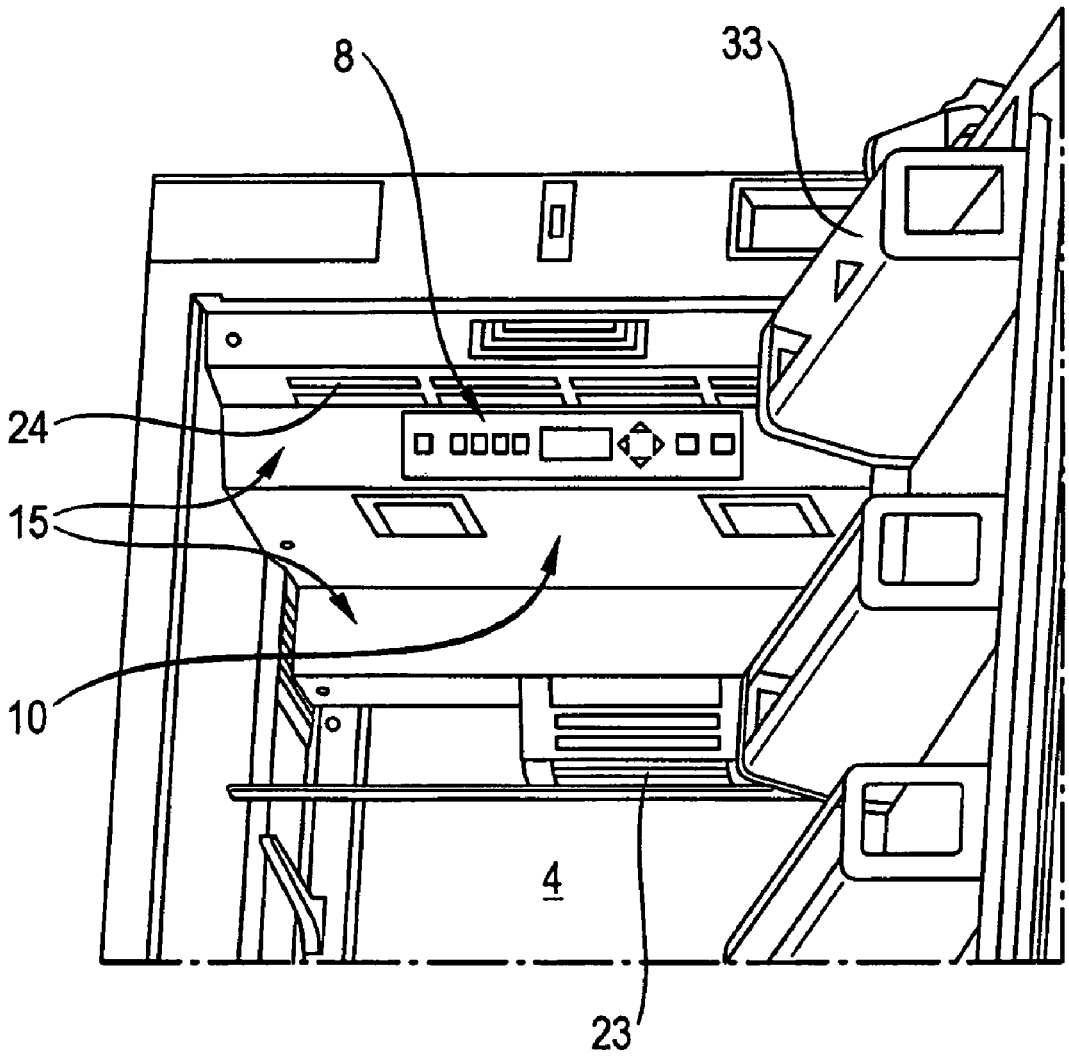

FIG. 10 shows a part view of the inventive refrigeration device 1 in a perspective view with the module 10, which is concealed from the storage compartment 4 by the cover panel 15. Door compartments 33 are provided in the door area.

Figure 11:
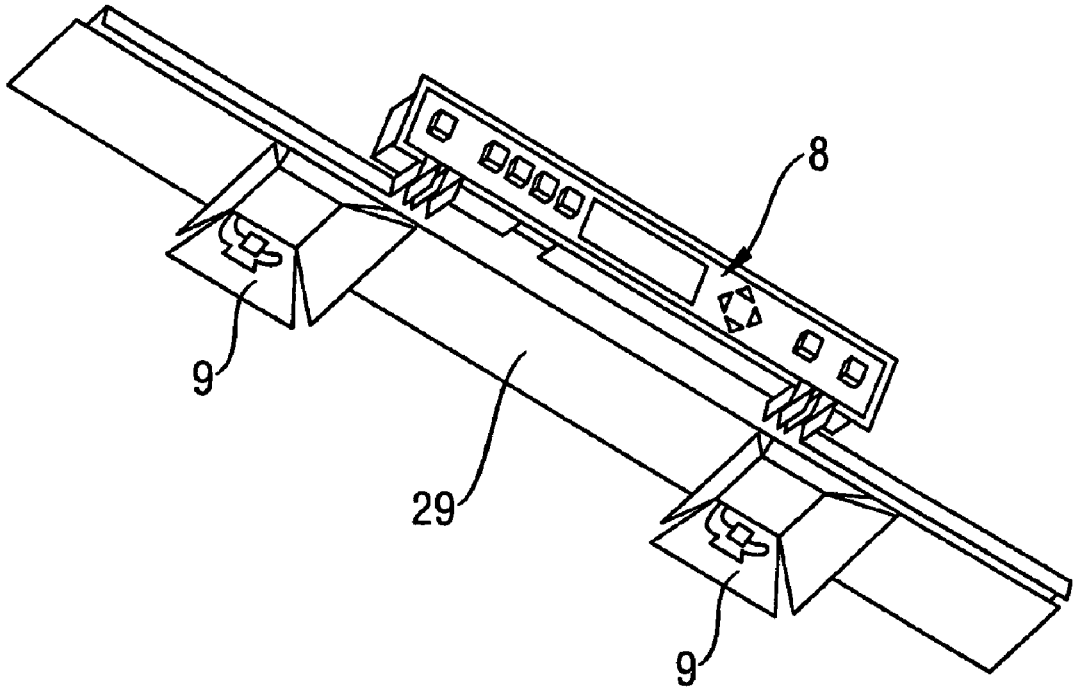

FIG. 11 shows a cross support 28 which connects the plastic side support parts 25, 26 to the left and right to the side walls 12 to each other which serves as a support for the electronic control system 8 as well as for the light source 9.

Figure 12:
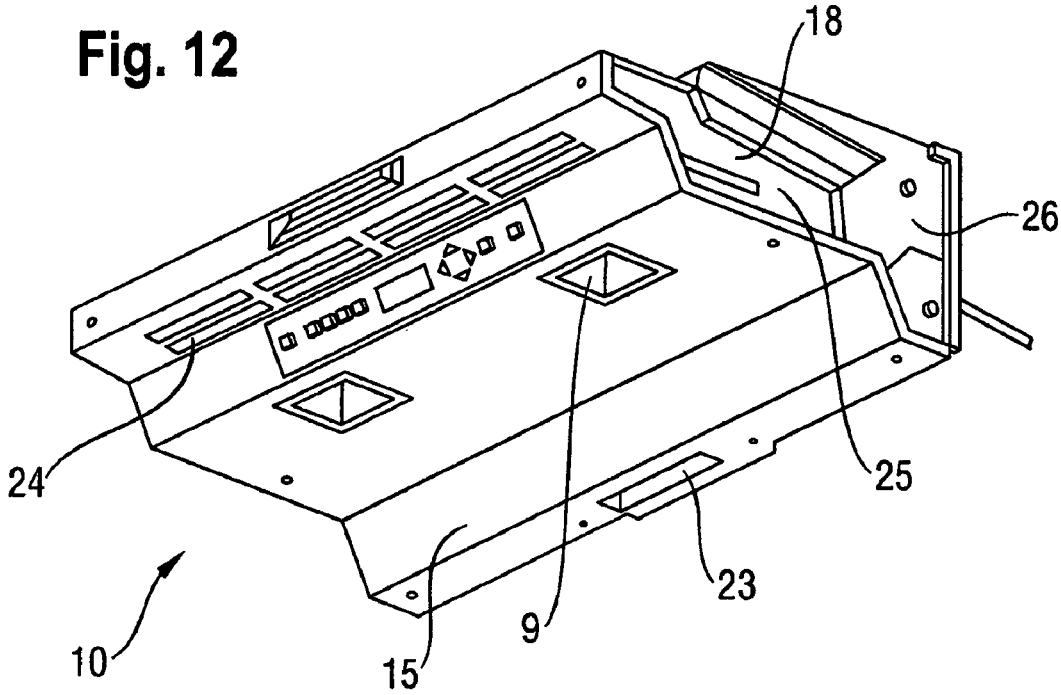
Figure 13:
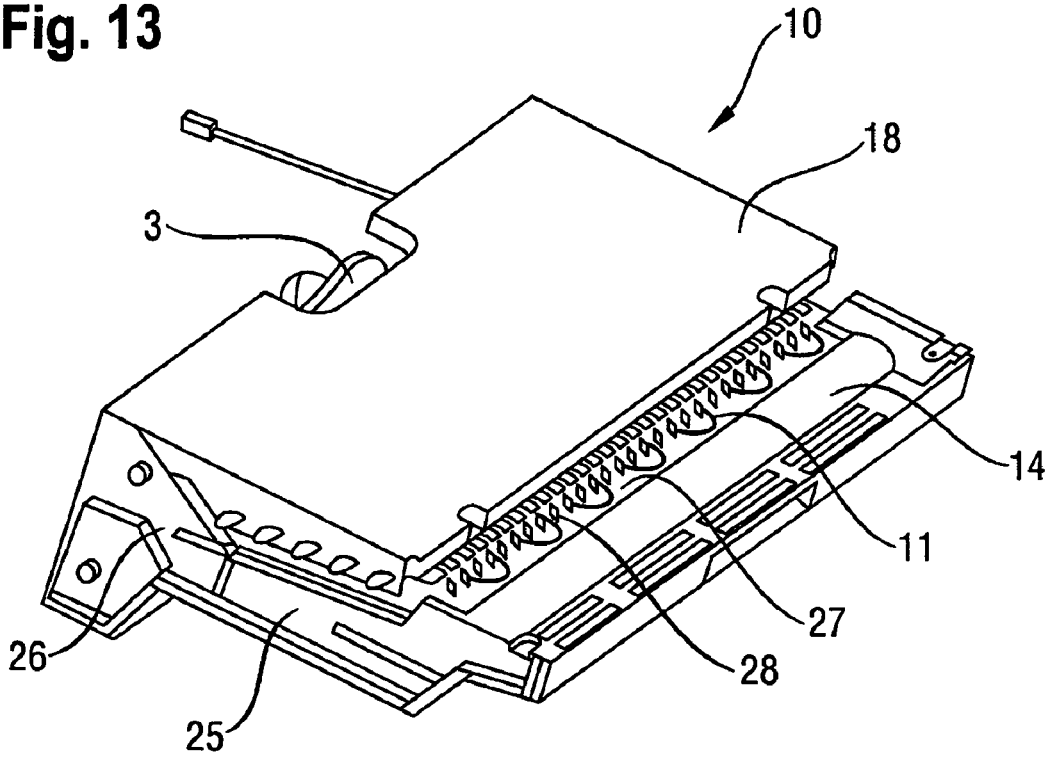

FIG. 12 shows a perspective view of the module 10 from below and FIG. 13 shows a perspective view of the module 10 from above.

Figure 14:
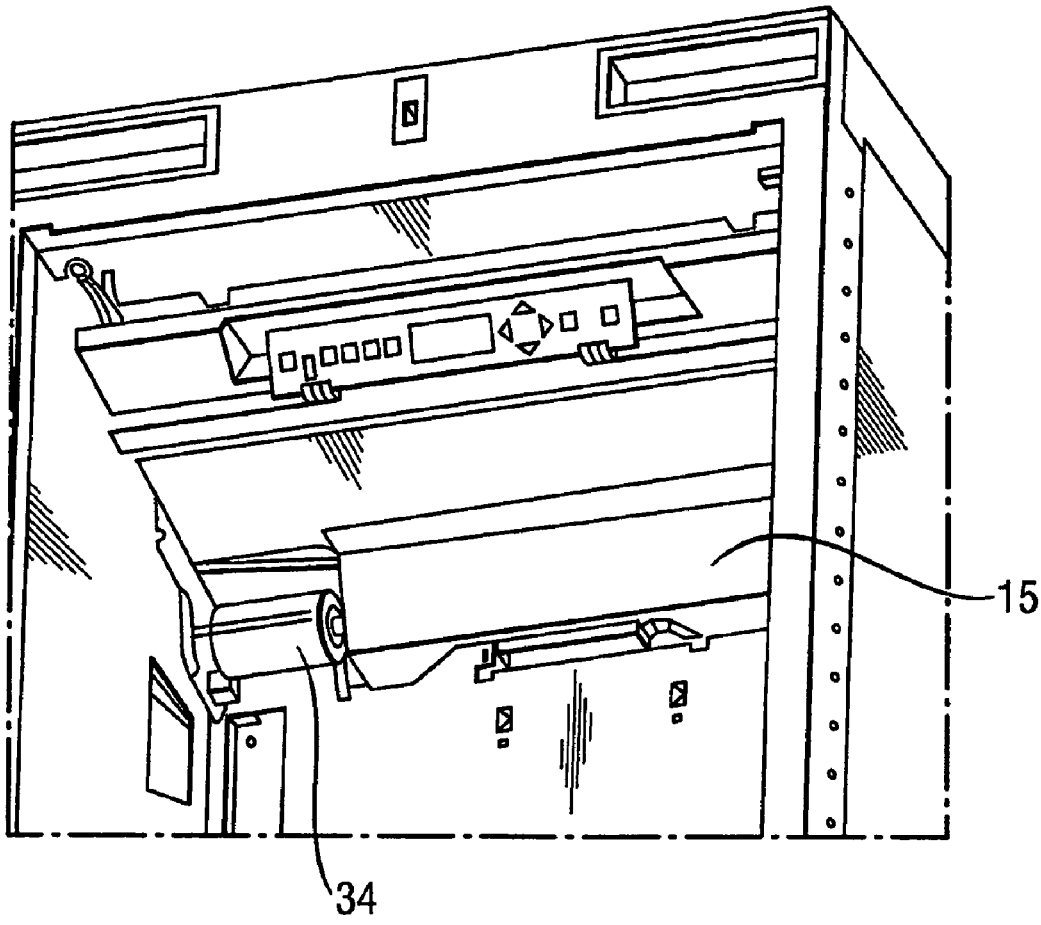

FIG. 14 is a perspective view of a section of the inventive kitchen device 1, with a further component 34, especially an electric motor drive, for adjusting the height of shelf surfaces in the storage compartment 4, being arranged between the cover plate 15 and insulation layer 14.

Figure 15:
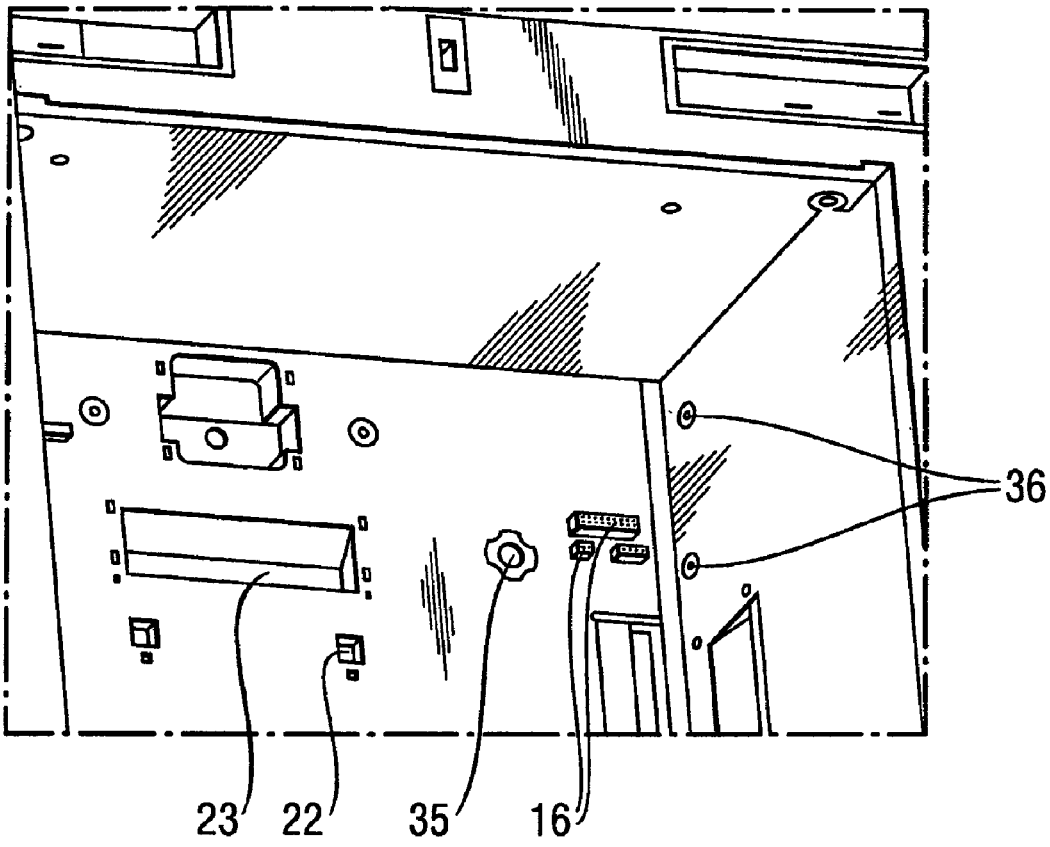

FIG. 15 shows a view into the interior of the inventive kitchen device 1 without the module 10. The first cooling air duct 23, the two connection elements 22, a water outlet 35 for condensation, the connector 16 and attachment means 36 for attaching the plastic side support parts 25, 26 can be seen in this diagram.

The invention relates to a refrigeration device 1, especially a no-frost device, refrigerator and/or freezer, comprising a thermally-insulating housing 2 within which at least one product storage compartment that can be supplied with cold air by a fan 3 and an evaporator chamber 4 that holds the evaporator 5 are provided, with the evaporator chamber 6 being thermally separated from the storage compartment 4 by a partition 7, an electronic control system 8 for control of the refrigeration device 1 and at least one light source 9 for illuminating the storage compartment 4, with the evaporator 5 and the partition 7 and the electronic control system 8 and/or the evaporator 5 and the partition 7 and the light source 9 being provided as a module 10. The refrigeration device 1 is characterized by especially reliable and efficient operation, low-cost manufacturing and an easy-to-maintain design.

LIST OF REFERENCE SYMBOLS

1 Refrigeration device
2 Housing
3 Fan
4 Storage compartment
5 Evaporator
6 Evaporator chamber
7 Partition
8 Electronic control system
9 Light source
10 Module
11 Heating device
12 Side walls
13 Condensation drainage channel
14 Insulation layer
15 Cover plate
16 Connector
17 Roof panel
18 Second insulation layer
19 Inner lining
20 Display
21 First connection element
22 Second connection element
23 First cooling air duct
24 Second cooling air duct

25 Front plastic side support part
26 Rear plastic side support part
27 Heat transfer plate
28 Evaporator fins
29 Cross support
30 Undercut structure
31 Third connection element
32 Through slot and attachment hooks
33 Door compartments
34 Further component
35 Water outlet
36 Attachment means

The invention claimed is:

1. A refrigeration device comprising:

a thermally-insulating housing having at least one product storage compartment;

a fan for supplying cold air to the product storage compartment;

an evaporator;

an evaporator chamber holding the evaporator;

a partition; the evaporator chamber being thermally separated from the storage compartment by the partition;

an electronic control system for controlling the refrigeration device;

at least one light source for illuminating the storage compartment; and a module; the evaporator and the partition and the electronic control system forming part of the module, wherein the module includes a cross support for accommodating at least one of the electronic control system and the at least one light source.

2. The refrigeration device as claimed in claim 1, wherein the module further includes a condensation drainage channel.

3. The refrigeration device as claimed in claim 1, wherein the module further includes a heating device.

4. The refrigeration device as claimed in claim 3, wherein the heating device is a heat transfer plate.

5. The refrigeration device as claimed in claim 3, wherein the module further includes a condensation drainage channel; the heating device located below the condensation drainage channel.

6. The refrigeration device as claimed in claim 1, wherein the housing includes opposite side walls; the module having plastic side support parts for attaching the module to the side walls.

7. The refrigeration device as claimed in claim 6, wherein the plastic side support parts are each divided into two parts.

8. The refrigeration device as claimed in claim 1, wherein the partition includes a first insulation layer adjacent to the evaporator chamber and a cover plate adjacent to the storage compartment.

9. The refrigeration device as claimed in claim 1, further including at least one electrical connector; the module being connectable to the refrigeration device by the electrical connector.

10. The refrigeration device as claimed in claim 1, wherein the module is preassembled.

11. The refrigeration device as claimed in claim 1, wherein the fan is part of the module.

12. The refrigeration device as claimed in claim 1, wherein the housing includes a roof panel; the module includes an insulation layer for thermally insulating the module from the roof panel.

13. The refrigeration device as claimed in claim 1, wherein the housing includes a metallic inner lining.

14. The refrigeration device as claimed in claim 1, wherein the light source includes white light-emitting diodes.

15. The refrigeration device as claimed in claim 1, wherein the refrigeration device is a no-frost device.

16. The refrigeration device as claimed in claim 1, wherein the refrigeration device is a refrigerator.

17. The refrigeration device as claimed in claim 1, wherein the refrigeration device is a freezer.

18. The refrigeration device as claimed in claim 1, wherein the light source forms a part of the module.

* * * * *